US007507910B2

(12) United States Patent
Park et al.

(10) Patent No.: US 7,507,910 B2
(45) Date of Patent: Mar. 24, 2009

(54) ASYMMETRICAL SEPARATOR AND COMMUNICATION CABLE HAVING THE SAME

(75) Inventors: Chan-Yong Park, Seoul (KR); Jong-Seb Baeck, Daegu (KR); Gi-Joon Nam, Seoul (KR); Woo-Yong Dong, Gyeongsangbuk-do (KR)

(73) Assignee: LS Cable Ltd., Anyang (KR)

( * ) Notice: Subject to any disclaimer, the term of this patent is extended or adjusted under 35 U.S.C. 154(b) by 0 days.

(21) Appl. No.: 11/832,850

(22) Filed: Aug. 2, 2007

(65) Prior Publication Data

US 2008/0023213 A1 Jan. 31, 2008

Related U.S. Application Data

(62) Division of application No. 11/513,296, filed on Aug. 29, 2006, now abandoned.

(30) Foreign Application Priority Data

Aug. 30, 2005 (KR) ..... 10-2005-0080162

(51) Int. Cl.
*H01B 7/00* (2006.01)

(52) U.S. Cl. ..... 174/113 C

(58) Field of Classification Search ..... 174/113 C, 174/113 R, 131 A

See application file for complete search history.

(56) References Cited

U.S. PATENT DOCUMENTS

2004/0055781 A1 * 3/2004 Cornibert et al. ..... 174/135

* cited by examiner

*Primary Examiner*—Chau N Nguyen
(74) *Attorney, Agent, or Firm*—Jones Day

(57) ABSTRACT

A separator for a communication cable includes a plurality of barriers formed in a radial direction so that at least two pair units, in each of which at least two insulation-coated wires are spirally twisted, are received in spaces formed by the barriers one by one so as to separate the pair units from each other. At least one of the barriers has a relatively greater thickness than the other barriers. Thus, a communication cable having the separator may prevent PSNEXT (Power Sum Near and Crosstalk) caused by interference between adjacent wires when a high frequency signal is transmitted through the wires.

4 Claims, 6 Drawing Sheets

ASYMMETRICAL SEPARATOR AND COMMUNICATION CABLE HAVING THE SAME

CROSS-REFERENCE TO RELATED APPLICATION

This application is a divisional application of U.S. patent application Ser. No. 11/513,296, filed Aug. 29, 2006, now abandoned, which claims the benefit of Korean Patent Application No. 10-2005-0080162, filed Aug. 30, 2005, the entireties of which are incorporated herein by reference.

BACKGROUND OF THE INVENTION

1. Field of the Invention

The present invention relates to a separator inserted into a communication cable, and a communication cable having the separator.

2. Description of the Related Art

Generally, a communication data cable is used for bulk data transmission using LAN (Local Area Network) or IBS (Intelligent Building System). The communication data cable is classified into Category 5, Category 6 and Category 7 depending on its transmission characteristic and also into UTP (Unshielded Twisted Pair) cable, FTP (Foiled Twisted Pair) cable and STP (Shielded Twisted Pair) cable depending on its shield.

An UTP cable generally transmits signals at a rate of about 100 Mbps. In order to enhance the transmission rate of signals through the UTP cable over 1 Gbps, a frequency of about 500 MHz should be used. However, in case a higher frequency is used for high-speed transmission of signals, there occur PSNEXT (Power Sum Near and Crosstalk) between pair units in the UTP cable, attenuation of signal passing along copper, and delay of signals. In order to prevent the PSNEXT between pair units in the UTP cable, a cable having a shield film between the pair units (for example, see Korean Patent No. 0330921) or a method for adjusting pitches of adjacent pair units differently as been proposed.

However, though a shield film is formed or pitches of pair units are different,

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail referring to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 2:
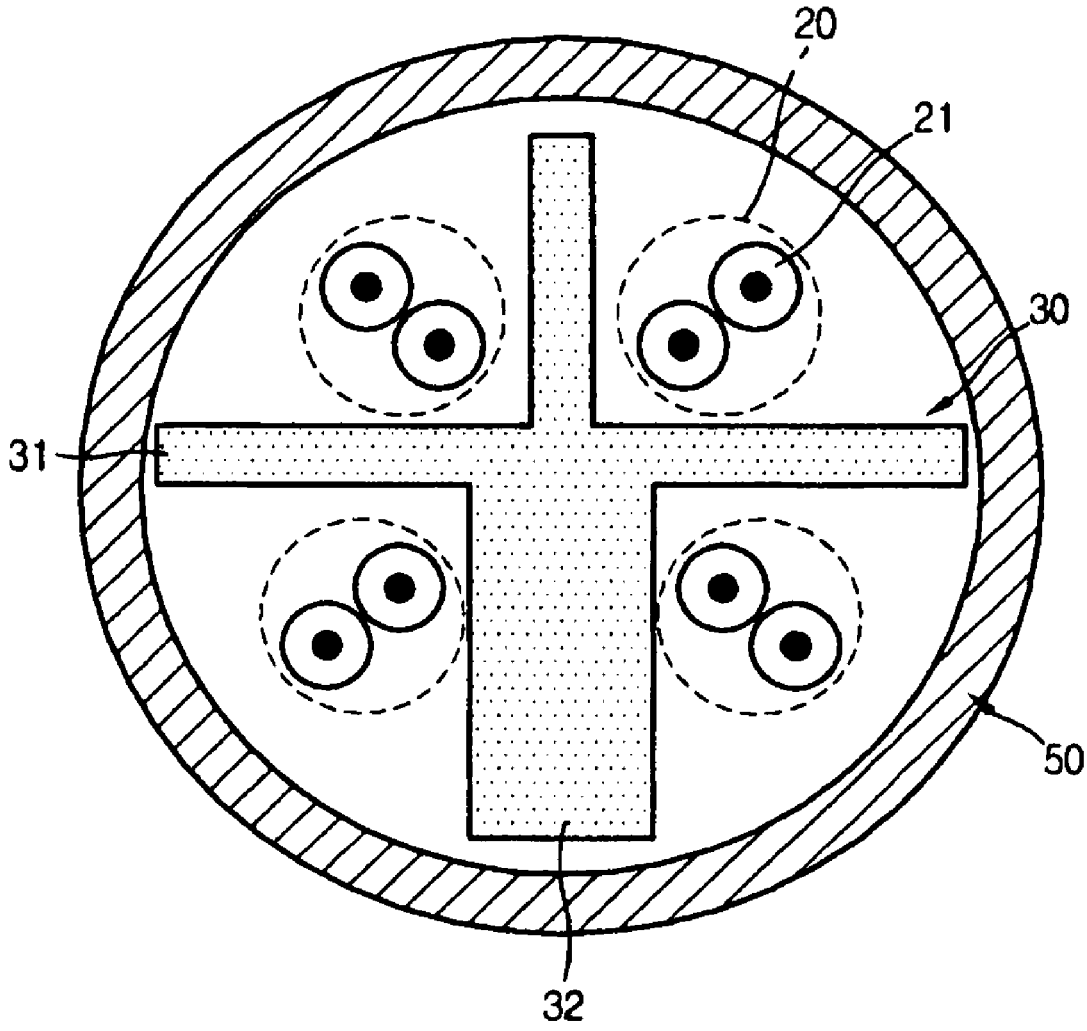
FIG. 2 is a sectional view showing a communication cable having a separator according to a preferred embodiment of the present invention.

FIG. 2 is a sectional view showing a communication cable having a separator according to a preferred embodiment of the present invention. Referring to FIG. 2, the communication cable according to this embodiment includes four pair units 20 in each of which two insulation-coated wires are spirally twisted, a separator 30 for isolating and separating the pair units 20 from each other, and an outside jacket 50 surrounding the pair units 20 and the separator 30.

The pair unit 20 is formed by twisting two wires 21 in which an insulating material is coated on a conductor. At this time, if many pair units 20 have pitches identical or similar to each other, PSNEXT (Power Sum Near and Crosstalk) may be easily generated between the pair units 20. Thus, the pair units 20 are preferably adjusted to have different pitches from each other.

Meanwhile, though it has been illustrated in this embodiment that four pair units 20 are provided, the number of pair units 20 provided in a cable may be variously changed, not limited to this embodiment. Furthermore, the number of wires 21 in each pair unit 20 may also be changed.

The separator 30 has barriers 31 crossing with each other to isolate the pair units 20 from each other so that PSNEXT between the pair units 20 may be prevented. The pair units 20 provided in the cable have different pitches. However, in case pair units 20 having similar pitches are positioned adjacently, PSNEXT is generated. This PSNEXT is seriously influenced by a distance between the pair units 20. That is to say, if a distance of pair units 20 having similar pitches is short, much PSNEXT is generated. In addition, if a distance of pair units 20 having similar pitches is longer, PSNEXT is abruptly decreased. Thus, in order to separate the pair units 20 having similar pitches by a longer distance, at least one barrier becomes thicker than the other barriers. Here, a thick barrier is called a second barrier 32, and the other barriers are called a first barrier 31. At this time, if a thickness of the second barrier 32 is less than 1.5 times of a thickness of the first barrier 31, PSNEXT is continuously generated. In addition, if a thickness of the second barrier 32 is more than 3 times of a thickness of the first barrier 31, a diameter of the cable is excessively increased. Thus, the thickness of the second barrier 32 is preferably in the range of 1.5 to 3 times of the thickness of the first barrier 31.

Meanwhile, in case the first barrier 31 has a thickness of 0.3 mm or less, it is impossible to prevent the generation of PSNEXT. In addition, in case the first barrier 31 has a thickness of 0.5 mm or more, the cable has an unnecessarily increased diameter to cause a problem in reducing its size. Thus, the first barrier 31 preferably has a thickness of 0.3 to 0.5 mm.

Additionally, in case the second barrier 32 has a thickness of 1.2 mm or less, it is impossible to prevent PSNEXT between the pair units 32 whose pitches have minimum difference. In addition, in case the second barrier 32 has a thickness of 1.5 mm or more, the cable has an unnecessarily increased diameter to cause a problem in reducing its size. Thus, the second barrier 32 preferably has a thickness of 1.2 to 1.5 mm.

In addition, though it has been illustrated in this embodiment that the separator 30 has four barriers for separating four pair units 20 from each other, the number of barriers may be changed in various ways depending on the number of pair units 20. For example, the separator 30 may be configured to have a plurality of barriers in a radial direction so that one pair unit 20 is received in each space formed between the barriers.

Figure 3:
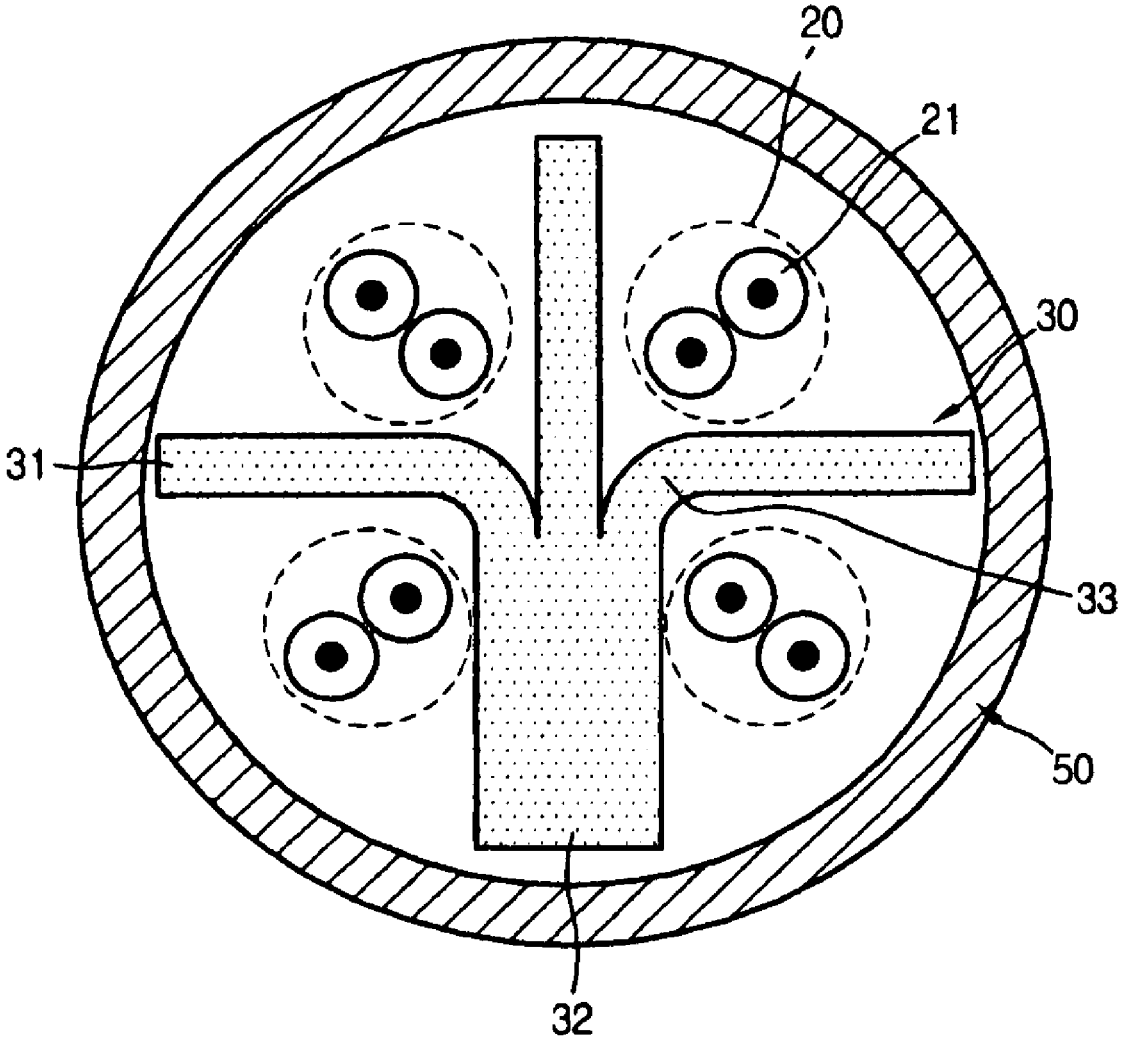
FIG. 3 is a sectional view showing a communication cable having a separator according to another embodiment of the present invention.

Meanwhile, in a cable according to another embodiment as shown in FIG. 3, among the first barriers 31 provided in the separator 30, the first barriers 31 adjacent to the second barrier 32 have a curved region 33. The curved region 33 makes the first barriers 31 be oriented upward on the drawing, so the first barriers 31 adjacent to the second barrier 32 are elastically biased in a direction opposite to the second barrier 32. This separator 30 configured as above may protect upper two pair units (positioned in an upper portion on the drawing) more surely against any PSNEXT caused by lower pair units (positioned in a lower portion on the drawing) having similar pitches.

In addition, if the first and second barriers 31, 32 provided between the pair units 20 have different thicknesses, the pair unit 20 may be deviated while the pair units 20 and the separator 30 are aggregated. Thus, in a still another embodiment shown in FIG. 4, a pair stopper 40 is provided to the first barrier 31 to cross with the first barrier 31. The pair stopper 40 is preferably contacted with an adjacent pair stopper 40 so as to prevent the pair unit 20 from being deviated. The pair stopper 40 may be integrally formed with the separator 30 using the same material, or be independently prepared and then attached to the separator 30.

Now, the communication cable of the present invention capable of preventing PSNEXT in a high-speed data transmission environment will be described in more detail based on the following examples.

COMPARATIVE EXAMPLE

Figure 1:
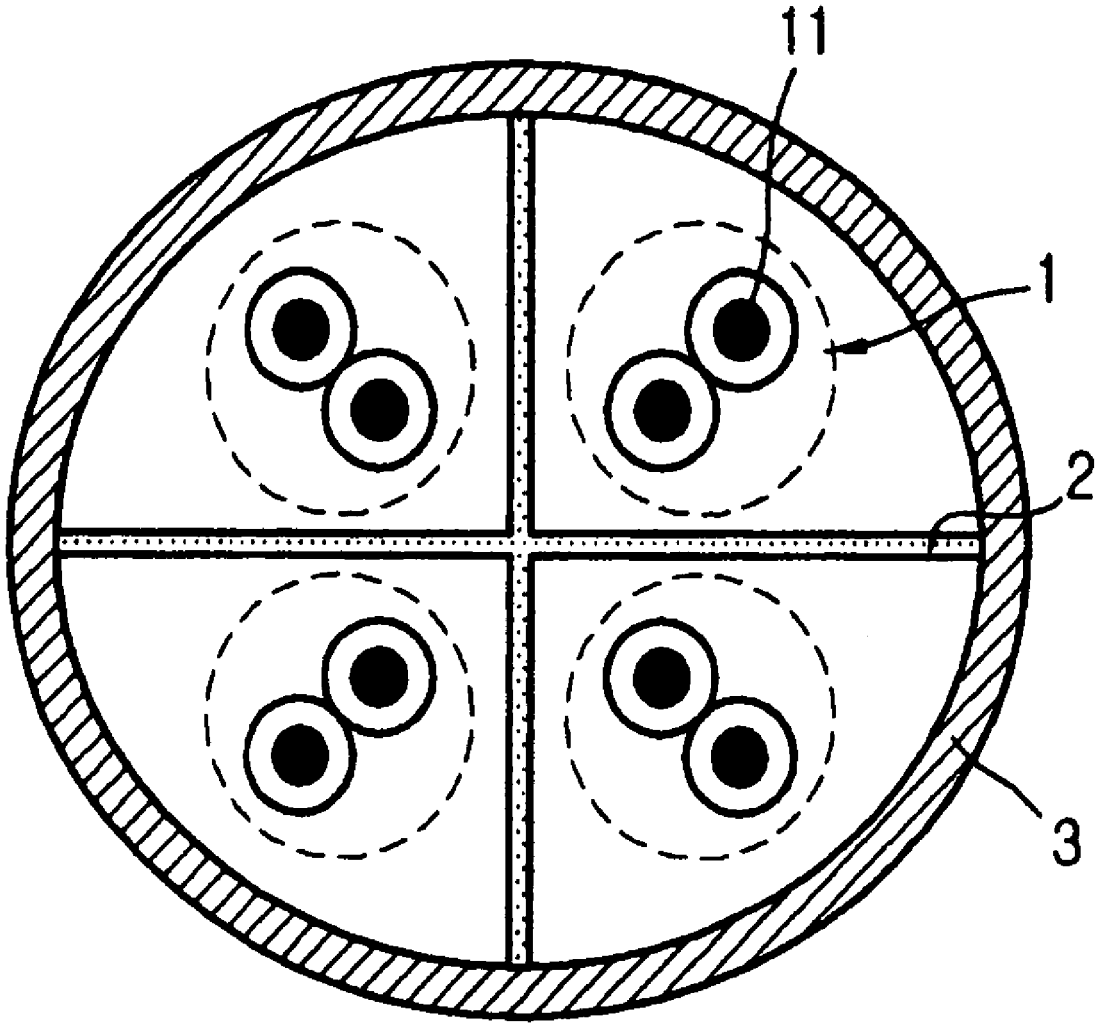
FIG. 1 (PRIOR ART)
FIG. 1 is a sectional view showing an UTP (Unshielded Twisted Pair) cable according to the prior art.

A conventional Cat. 6 cable is selected for this comparative example (see FIG. 1). The cable used in this comparative example includes four pair units 1 in each of which two wires 11 are spirally twisted, a separator 2 for isolating the pair units 1 from each other, and an outside jacket 3 surrounding the pair units 1 and the separator 2. Pitches of four pair units 1 are respectively 10.3 mm, 11.4 mm, 12.9 mm and 14.6 mm. At this time, the pair units 1 having pitches of 14.6 mm, 10.3 mm, 12.9 mm and 11.4 mm are arranged in a counterclockwise direction from the first quadrant so as to prevent pair units having similar pitches from being positioned adjacent. However, in spite of the above arrangement, at least one pair of pair units unavoidably has similar pitches (in this comparative example, the pair units having pitches of 12.9 mm and 11.4 mm).

In addition, the outer jacket 3 is made of PVC (polyvinyl chloride) with a thickness of 0.6 mm. In addition, the separator 2 of the cable used in this comparative example has barriers with the same thickness for separating the pair units 1 from each other. Moreover, there is no structure installed on the cable used in this comparative example.

Figure 5:
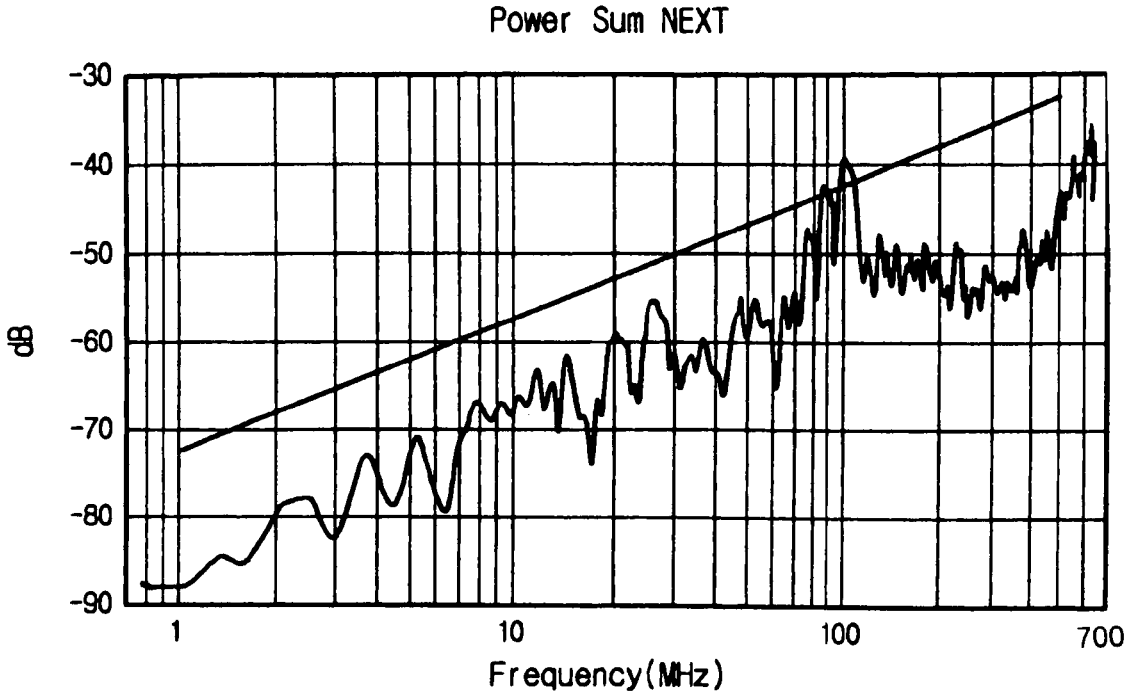
FIG. 5 is a graph showing a measurement result of PSNEXT of the conventional UTP cable prepared according to a comparative example.

By using the conventional cable mentioned above, signals are transmitted over a length of 100 m with changing frequencies in the range of 1 MHz to 700 MHz according to the IEEE 802.3 draft standard. At this time, data loss caused by PSNEXT was measured, and the measurement results are shown in FIG. 5. A solid line in FIG. 5 shows a PSNEXT criterion proposed in the IEEE 802.3 draft standard, and a waved line is a measurement result of this comparative example.

Experimental Example

Figure 4:
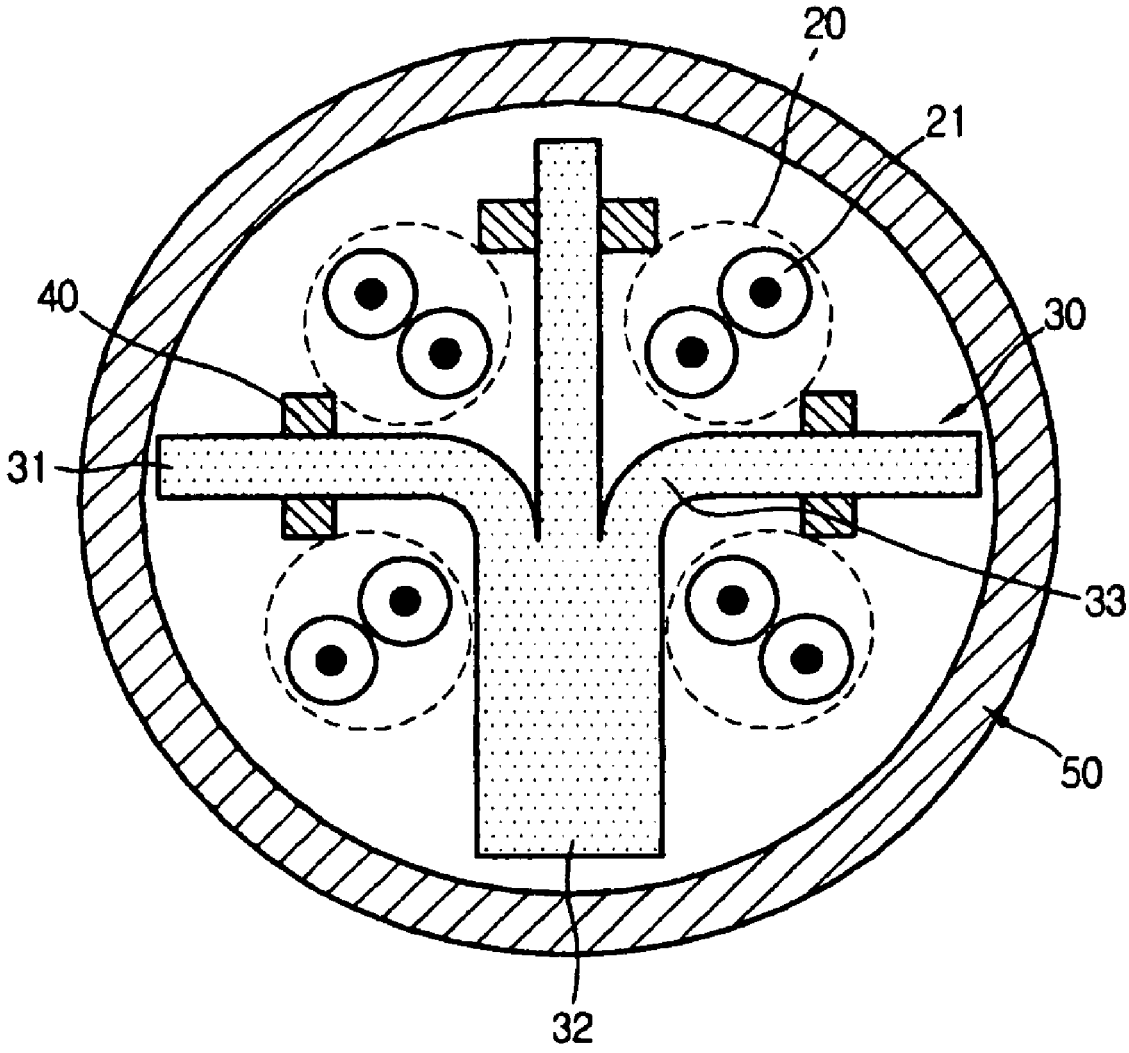
FIG. 4 is a sectional view showing a communication cable having a separator according to still another embodiment of the present invention.

A cable used in this experimental example according to the present invention includes four pair units 20 in each of which two wires 21 are spirally twisted, a separator 30 for separating the pair units 20 from each other, and an outside jacket 50 surrounding the pair units 20 and the separator 30 (see FIG. 4). The separator 30 includes first barriers 31, and a second barrier 32 whose thickness is relatively greater than the first barrier 31. Pitches of four pair units 20 are respectively 10.3 mm, 11.4 mm, 12.9 mm and 14.6 mm. In addition, these pair units 20 are arranged in the same way as in the comparative example. That is to say, the pair units 20 having pitches of 14.6 mm, 10.3 mm, 12.9 mm and 11.4 mm are arranged in a counterclockwise direction from the first quadrant. As a result, the pair units 20 having pitches of 11.4 mm and 12.9 mm are positioned adjacently near the second barrier 32. In addition, a pair stopper 40 is provided to one end of the separator 30. The separator 30 and the pair stopper 40 are made of HDPE (High Density Polyethylene), and the outer jacket 50 is made of PVC with a thickness of 0.6 mm.

Figure 6:
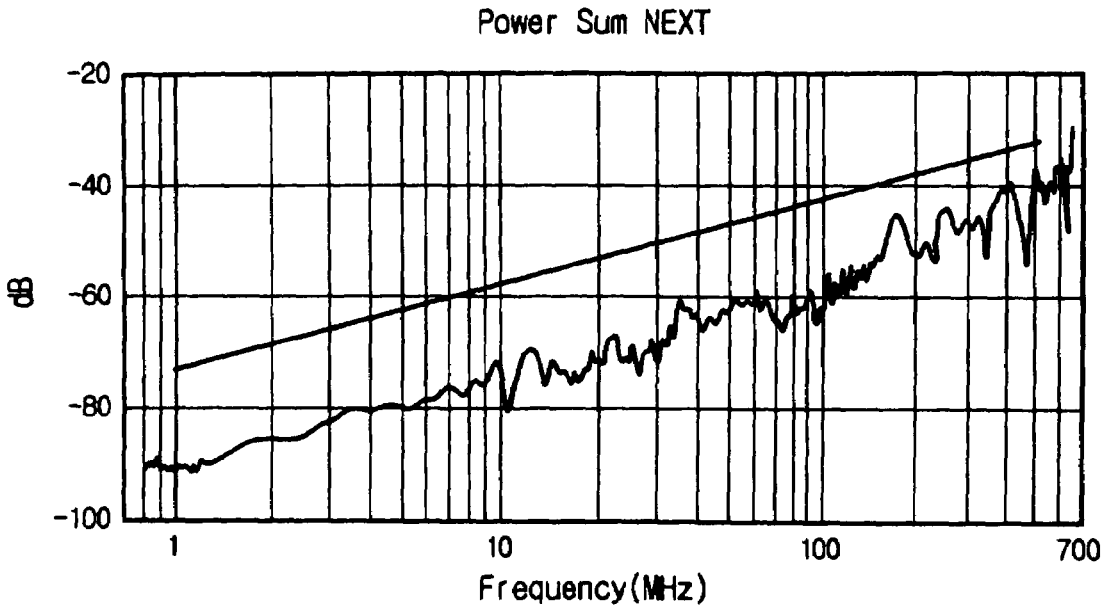
FIG. 6 is a graph showing a measurement result of PSNEXT prepared according to an experimental example of the present invention.

By using the cable prepared according to the present invention as mentioned above, signals are transmitted over a length of 100 m with changing frequencies in the range of 1 MHz to 700 MHz according to the IEEE 802.3 draft standard. At this time, data loss caused by PSNEXT was measured, and the measurement results are shown in FIG. 6. A solid line in FIG. 6 shows a PSNEXT criterion proposed in the IEEE 802.3 draft standard, and a waved line is a measurement result of this experimental example.

Referring to FIG. 5, the cable produced by the comparative example according to the prior art passed all tests including fitted impedance, return loss, attenuation, FEXT (Far End Crosstalk), and ELFEXT (Equal Level Far End CrossTalk). However, in the frequency range of 80 to 100 MHz, a loss caused by PSNEXT of the cable exceeded the standard criterion.

Meanwhile, referring to FIG. 6, the cable produced according to the present invention passed all tests including fitted impedance, return loss, attenuation, FEXT, and ELFEXT. In addition, in the experiment of measuring PSNEXT, this cable showed a satisfactory result on a loss caused by PSNEXT.

Thus, since the pair units 20 having relatively similar pitches may keep a predetermined spacing distance between them by using the asymmetric separator 30 according to the present invention, signals transmitted through the pair units 20 are not influenced from each other.

As described above, the present invention has been described in detail referring to the accompanying drawings. However, it should be understood that the detailed description and specific embodiments of the invention are given by way of illustration only, not intended to limit the scope of the invention, since various changes and modifications within the spirit and scope of the invention will become apparent to those skilled in the art from this detailed description, so it should be understood that other equivalents and modifications within the spirit and scope of the invention will become apparent to those skilled in the art from this detailed description. For example, though it has been illustrated that the separator 30 having a spacer is provided in an UTP cable, the separator 30 may also be applied to a FTP cable or a STP cable in the same way.

APPLICABILITY TO THE INDUSTRY

The separator and the communication cable having the separator according to the present invention gives the following effects.

First, it is possible to decrease PSNEXT caused by pair units having similar pitches.

Second, it is possible to improve a transmission characteristic by restraining deterioration of signal characteristics caused by PSNEXT.

Third, the improvement of transmission characteristic obtained by restraining PSNEXT enables high-speed signal transmission.

Fourth, since the pair units are separated from each other at a suitable position, the present invention ensures reduction of material consumption, decrease of product weight, and simplification of structure.

What is claimed is:

1. A separator for a communication cable, which includes a plurality of barriers formed in a radial direction so that at least two pair units, in each of which at least two insulation-coated wires are spirally twisted, are received in spaces formed by the barriers one by one so as to separate the pair units from each other, wherein at least one of the barriers has a relatively greater thickness than the other barriers, and wherein the separator includes a pair stopper protruded from a surface of the other barriers so that the pair units are not deviated from the separator, wherein, among said other barriers, barriers adjacent to the barrier with a relatively greater thickness are elastically biased in a direction opposite to the barrier with a relatively greater thickness.

2. The separator according to claim 1, wherein the pair stopper is integrally formed with the other barriers.

3. A communication cable, comprising:

at least two pair units in each of which at least two insulation-coated wires are spirally twisted;

a separator including first barriers and at least one second barrier having a relatively greater thickness than the first barriers, the first and second barriers being interposed between the pair units so as to separate the pair units from each other;

an outside jacket surrounding the pair units and the separator, and a pair stopper protruded from a surface of the first barriers so that the pair units are not deviated from the separator, wherein, among the first barriers, barriers adjacent to the second barrier are elastically biased in a direction opposite to the second barrier.

4. The communication cable according to claim 3, wherein the pair stopper is integrally formed with the first barriers.

* * * * *